US006328113B1

(12) United States Patent
Cook

(10) Patent No.: US 6,328,113 B1
(45) Date of Patent: Dec. 11, 2001

(54) ISOLATION OF SUBTERRANEAN ZONES

(75) Inventor: Robert Lance Cook, Katy, TX (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/440,338

(22) Filed: Nov. 15, 1999

Related U.S. Application Data

(60) Provisional application No. 60/108,558, filed on Nov. 16, 1998.

(51) Int. Cl.[7] ..... E21B 43/14

(52) U.S. Cl. ..... 166/387; 166/50; 166/117.6

(58) Field of Search ..... 166/50, 313, 117.5, 166/117.6, 387, 66.6, 205

(56) References Cited

U.S. PATENT DOCUMENTS

| | | | |
|---|---|---|---|
| Re. 30,802 | 11/1981 | Rogers, Jr. | 29/421 R |
| 984,449 | 2/1911 | Stewart . | |
| 1,233,888 | 7/1917 | Leonard . | |
| 1,880,218 | 10/1932 | Simmons . | |
| 2,046,870 | 7/1936 | Clasen et al. . | |
| 2,214,226 | 9/1940 | English . | |
| 2,447,629 | 8/1948 | Beissinger et al. . | |
| 2,583,316 | 1/1952 | Bannister . | |
| 2,734,580 | 2/1956 | Layne . | |
| 2,796,134 | 6/1957 | Binkley . | |
| 2,812,025 | 11/1957 | Teague et al. . | |
| 3,067,819 | 12/1962 | Gore . | |
| 3,104,703 | 9/1963 | Rike et al. . | |
| 3,111,991 | 11/1963 | O'Neal . | |
| 3,167,122 | 1/1965 | Lang . | |
| 3,175,618 | 3/1965 | Lang et al. . | |
| 3,179,168 | 4/1965 | Vincent . | |
| 3,191,677 | 6/1965 | Kinley . | |
| 3,191,680 | 6/1965 | Vincent . | |
| 3,203,451 | 8/1965 | Vincent . | |
| 3,203,483 | 8/1965 | Vincent . | |
| 3,245,471 | 4/1966 | Howard . | |
| 3,270,817 | 9/1966 | Papaila . | |
| 3,297,092 | 1/1967 | Jennings . | |
| 3,326,293 | 6/1967 | Skipper . | |
| 3,353,599 | 11/1967 | Swift . | |
| 3,354,955 | 11/1967 | Berry . | |
| 3,358,760 | 12/1967 | Blagg . | |
| 3,358,769 | 12/1967 | Berry . | |
| 3,364,993 | 1/1968 | Skipper . | |
| 3,419,080 | 12/1968 | Lebourg . | |
| 3,477,506 | 11/1969 | Malone . | |
| 3,489,220 | 1/1970 | Kinley . | |
| 3,669,190 | 6/1972 | Sizer et al. | 166/315 |
| 3,691,624 | 9/1972 | Kinley | 29/523 |
| 3,693,717 | 9/1972 | Wuenschel | 166/285 |
| 3,712,376 | 1/1973 | Owen et al. | 166/277 |
| 3,746,091 | 7/1973 | Owen et al. | 166/207 |
| 3,746,092 | 7/1973 | Land | 166/207 |
| 3,776,307 | 12/1973 | Young | 166/125 |
| 3,785,193 | 1/1974 | Kinley et al. | 72/393 |
| 3,812,912 | 5/1974 | Wuenschel | 166/207 |
| 3,948,321 | 4/1976 | Owen et al. | 166/277 |

(List continued on next page.)

FOREIGN PATENT DOCUMENTS

| | | | |
|---|---|---|---|
| 736288 | 6/1966 | (CA) | 166/16 |
| 771462 | 11/1967 | (CA) | 166/16 |
| 1171310 | 7/1984 | (CA) | F16B/13/06 |
| 233607 | 3/1986 | (DE) | E21B/17/00 |
| 0823534 | 2/1998 | (EP) | E21B/7/06 |
| 0881354 | 12/1998 | (EP) | E21B/43/10 |
| 2717855 | 9/1995 | (FR) | E21B/17/00 |
| 2256910 | 12/1992 | (GB) | F16L/9/18 |

(List continued on next page.)

*Primary Examiner*—Frank Tsay
(74) *Attorney, Agent, or Firm*—Todd Mattingly; Haynes & Boone, LLP

(57) ABSTRACT

One or more subterranean zones are isolated from one or more other subterranean zones using a combination of solid tubulars and slotted tubulars.

35 Claims, 1 Drawing Sheet

U.S. PATENT DOCUMENTS

| | | | |
|---|---|---|---|
| 4,368,571 | 1/1983 | Cooper, Jr. | 29/421 R |
| 4,391,325 | 7/1983 | Baker et al. | 166/208 |
| 4,483,399 | 11/1984 | Colgate | 166/308 |
| 4,485,847 | 12/1984 | Wentzell | 138/89 |
| 4,505,017 | 3/1985 | Schukei | 29/157.3 R |
| 4,976,322 | 12/1990 | Abdrakhmanov et al. | 175/57 |
| 5,014,779 | 5/1991 | Meling et al. | 166/55.7 |
| 5,083,608 | 1/1992 | Abdrakhmanov et al. | 166/55 |
| 5,325,923 | 7/1994 | Surjaatmadja et al. | 166/308 |
| 5,348,095 | 9/1994 | Worrall et al. | 166/380 |
| 5,366,012 | 11/1994 | Lohbeck | 166/277 |
| 5,390,742 | 2/1995 | Dines et al. | 166/297 |
| 5,439,320 | 8/1995 | Abrams | 405/154 |
| 5,467,822 | 11/1995 | Zwart | 166/179 |
| 5,494,106 | 2/1996 | Gueguen et al. | 166/277 |
| 5,606,792 | 3/1997 | Schafer | 29/727 |
| 5,613,557 | 3/1997 | Blount et al. | 166/277 |
| 5,667,011 | 9/1997 | Gill et al. | 166/295 |
| 5,667,252 | 9/1997 | Schafer et al. | 285/15 |
| 5,685,369 | 11/1997 | Ellis et al. | 166/195 |
| 5,718,288 | 2/1998 | Bertet et al. | 166/287 |
| 5,785,120 | 7/1998 | Smalley et al. | 166/55 |
| 5,829,524 | 11/1998 | Flanders et al. | 166/277 |
| 5,901,789 | 5/1999 | Donnelly et al. | 166/381 |
| 5,924,745 | 7/1999 | Campbell | 285/90 |
| 5,957,195 | 9/1999 | Bailey et al. | 166/55 |
| 5,979,560 | 11/1999 | Nobileau | 166/381 |
| 5,984,568 | 11/1999 | Lohbeck | 403/375 |
| 6,012,522 | 1/2000 | Donnelly et al. | 166/276 |
| 6,012,523 | 1/2000 | Campbell et al. | 166/277 |
| 6,021,850 | 2/2000 | Wood et al. | 166/380 |
| 6,029,748 | 2/2000 | Forsyth et al. | 166/380 |
| 6,065,500 | 5/2000 | Metcalfe | 138/118 |
| 6,070,671 | 6/2000 | Cumming et al. | 166/381 |
| 6,079,495 | 6/2000 | Ohmer | 166/313 |
| 6,085,838 | 7/2000 | Vercaemer et al. | 166/277 |
| 6,089,320 | 7/2000 | LaGrange | 166/313 |
| 6,098,717 | 8/2000 | Bailey et al. | 166/382 |

FOREIGN PATENT DOCUMENTS

| | | | |
|---|---|---|---|
| 2322655 | 9/1998 | (GB) | E21B/23/04 |
| 2329918 | 4/1999 | (GB) | E21B/29/00 |
| 2336383 | 10/1999 | (GB) | E21B/43/08 |
| 2064357 | 7/1996 | (RU) | B21D/39/10 |
| 2068940 | 11/1996 | (RU) | E21B/29/10 |
| 2079633 | 5/1997 | (RU) | E21B/7/06 |
| 2105128 | 2/1998 | (RU) | E21B/29/00 |
| 2108445 | 4/1998 | (RU) | E21B/33/13 |
| 612004 | 5/1978 | (SU) | E21B/29/00 |
| 620582 | 7/1978 | (SU) | E21B/29/00 |
| 832049 | 5/1981 | (SU) | E21B/29/00 |
| 853089 | 8/1981 | (SU) | E21B/29/00 |
| 1411434 | 7/1988 | (SU) | E21B/29/10 |
| 1627663 | 2/1991 | (SU) | E21B/29/10 |
| 1710694 | 2/1992 | (SU) | E21B/29/10 |
| 1745873 | 7/1992 | (SU) | E21B/29/10 |
| 1810482 | 4/1993 | (SU) | E21B/29/10 |
| 1818459 | 5/1993 | (SU) | E21B/29/10 |
| 9325799 | 12/1993 | (WO) | E21B/43/10 |
| 9325800 | 12/1993 | (WO) | E21B/43/10 |
| 9421887 | 9/1994 | (WO) | E21B/33/14 |
| 9503476 | 2/1995 | (WO) | E21B/43/10 |
| 9637681 | 11/1996 | (WO) | E21B/17/08 |
| 9706346 | 2/1997 | (WO) | E21B/43/10 |
| 9717524 | 5/1997 | (WO) | E21B/43/08 |
| 9717526 | 5/1997 | (WO) | E21B/43/10 |
| 9717527 | 5/1997 | (WO) | E21B/43/10 |
| 9720130 | 6/1997 | (WO) | E21B/43/10 |
| 9721901 | 6/1997 | (WO) | E21B/17/08 |
| 9800626 | 1/1998 | (WO) | E21B/43/10 |
| 9809053 | 3/1998 | (WO) | E21B/33/14 |
| 9826152 | 6/1998 | (WO) | E21B/17/08 |
| 9902818 | 1/1999 | (WO) | E21B/43/10 |
| 9918328 | 4/1999 | (WO) | E21B/23/01 |
| 9923354 | 5/1999 | (WO) | E21B/43/10 |
| 9925951 | 5/1999 | (WO) | E21B/43/10 |

* cited by examiner

ISOLATION OF SUBTERRANEAN ZONES

CROSS REFERENCE TO RELATED APPLICATIONS

This application claims the benefit of the filing date of U.S. Provisional Patent Application Serial No. 60/108,558, filed on Nov. 16, 1998, the disclosure of which is incorporated herein by reference.

BACKGROUND OF THE INVENTION

This invention relates generally to oil and gas exploration, and in particular to isolating certain subterranean zones to facilitate oil and gas exploration.

During oil exploration, a wellbore typically traverses a number of zones within a subterranean formation. Some of these subterranean zones will produce oil and gas, while others will not. Further, it is often necessary to isolate subterranean zones from one another in order to facilitate the exploration for and production of oil and gas. Existing methods for isolating subterranean production zones in order to facilitate the exploration for and production of oil and gas are complex and expensive.

The present invention is directed to overcoming one or more of the limitations of the existing processes for isolating subterranean zones during oil and gas exploration.

SUMMARY OF THE INVENTION

According to one aspect of the present invention, an apparatus is provided that includes one or more solid tubular members, one or more slotted tubular members, and a shoe. The slotted tubular members are coupled to the solid tubular members. The shoe is coupled to the slotted tubular members. Each solid tubular member includes one or more external seals.

According to another aspect of the present invention, an apparatus is provided that includes one or more primary solid tubulars, n slotted tubulars, n−1 intermediate solid tubulars, and a shoe. Each primary solid tubular includes one or more external annular seals. The slotted tubulars are coupled to the primary solid tubulars. The intermediate solid tubulars are coupled to and interleaved among the slotted tubulars. Each intermediate solid tubular includes one or more external annular seals. The shoe is coupled to one of the slotted tubulars.

According to another aspect of the present invention, a method of isolating a first subterranean zone from a second subterranean zone in a wellbore is provided that includes positioning one or more primary solid tubulars, and one or more slotted tubulars within the wellbore. The primary solid tubulars traverse the first subterranean zone. The slotted tubulars traverse the second subterranean zone. The slotted tubulars and the primary solid tubulars are fluidicly coupled. The passage of fluids from the first subterranean zone to the second subterranean zone within the wellbore external to the solid and slotted tubulars is prevented.

According to another aspect of the present invention, a method of extracting materials from a producing subterranean zone in a wellbore, in which at least a portion of the wellbore includes a casing, is provided that includes positioning one or more primary solid tubulars and slotted tubulars within the wellbore. The primary solid tubulars are fluidicly coupled with the casing. The slotted tubulars traverse the producing subterranean zone. The producing subterranean zone is fluidicly isolated from at least one other subterranean zone within the wellbore. At least one of the slotted tubulars is fluidicly coupled with the producing subterranean zone.

DETAILED DESCRIPTION OF THE ILLUSTRATION EMBODIMENTS

Figure 1:
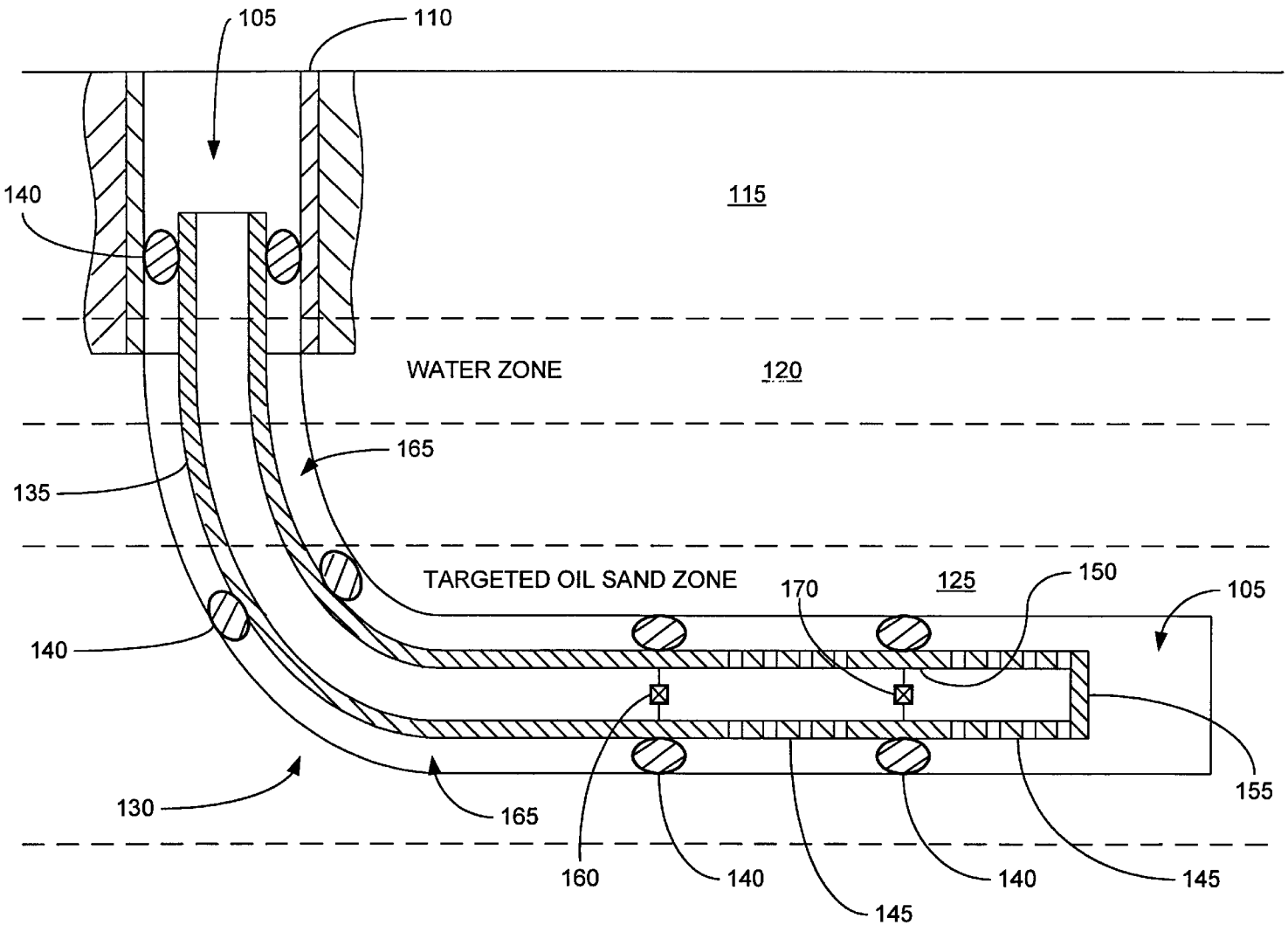
FIG. 1 is a fragmentary cross-sectional view illustrating the isolation of subterranean zones.

An apparatus and method for isolating one or more subterranean zones from one or more other subterranean zones is provided. The apparatus and method permits a producing zone to be isolated from a nonproducing zone using a combination of solid and slotted tubulars. In the production mode, the teachings of the present disclosure may be used in combination with conventional, well known, production completion equipment and methods using a series of packers, solid tubing, perforated tubing, and sliding sleeves, which will be inserted into the disclosed apparatus to permit the commingling and/or isolation of the subterranean zones from each other.

Referring to FIG. 1, a wellbore 105 including a casing 110 are positioned in a subterranean formation 115. The subterranean formation 115 includes a number of productive and non-productive zones, including a water zone 120 and a targeted oil sand zone 125. During exploration of the subterranean formation 115, the wellbore 105 may be extended in a well known manner to traverse the various productive and non-productive zones, including the water zone 120 and the targeted oil sand zone 125.

In a preferred embodiment, in order to fluidicly isolate the water zone 120 from the targeted oil sand zone 125, an apparatus 130 is provided that includes one or more sections of solid casing 135, one or more external seals 140, one or more sections of slotted casing 145, one or more intermediate sections of solid casing 150, and a solid shoe 155.

The solid casing 135 may provide a fluid conduit that transmits fluids and other materials from one end of the solid casing 135 to the other end of the solid casing 135. The solid casing 135 may comprise any number of conventional commercially available sections of solid tubular casing such as, for example, oilfield tubulars fabricated from chromium steel or fiberglass. In a preferred embodiment, the solid casing 135 comprises oilfield tubulars available from various foreign and domestic steel mills.

The solid casing 135 is preferably coupled to the casing 110. The solid casing 135 may be coupled to the casing 110 using any number of conventional commercially available processes such as, for example, welding, slotted and expandable connectors, or expandable solid connectors. In a preferred embodiment, the solid casing 135 is coupled to the casing 110 by using expandable solid connectors. The solid casing 135 may comprise a plurality of such solid casing 135.

The solid casing 135 is preferably coupled to one more of the slotted casings 145. The solid casing 135 may be coupled to the slotted casing 145 using any number of conventional commercially available processes such as, for example, welding, or slotted and expandable connectors. In a preferred embodiment, the solid casing 135 is coupled to the slotted casing 145 by expandable solid connectors.

In a preferred embodiment, the casing 135 includes one more valve members 160 for controlling the flow of fluids and other materials within the interior region of the casing 135. In an alternative embodiment, during the production mode of operation, an internal tubular string with various arrangements of packers, perforated tubing, sliding sleeves, and valves may be employed within the apparatus to provide various options for commingling and isolating subterranean zones from each other while providing a fluid path to the surface.

In a particularly preferred embodiment, the casing 135 is placed into the wellbore 105 by expanding the casing 135 in the radial direction into intimate contact with the interior walls of the wellbore 105. The casing 135 may be expanded in the radial direction using any number of conventional commercially available methods.

The seals 140 prevent the passage of fluids and other materials within the annular region 165 between the solid casings 135 and 150 and the wellbore 105. The seals 140 may comprise any number of conventional commercially available sealing materials suitable for sealing a casing in a wellbore such as, for example, lead, rubber or epoxy. In a preferred embodiment, the seals 140 comprise Stratalok epoxy material available from Halliburton Energy Services. The slotted casing 145 permits fluids and other materials to pass into and out of the interior of the slotted casing 145 from and to the annular region 165. In this manner, oil and gas may be produced from a producing subterranean zone within a subterranean formation. The slotted casing 145 may comprise any number of conventional commercially available sections of slotted tubular casing. In a preferred embodiment, the slotted casing 145 comprises expandable slotted tubular casing available from Petroline in Abeerdeen, Scotland. In a particularly preferred embodiment, the slotted casing 145 comprises expandable slotted sandscreen tubular casing available from Petroline in Abeerdeen, Scotland.

The slotted casing 145 is preferably coupled to one or more solid casing 135. The slotted casing 145 may be coupled to the solid casing 135 using any number of conventional commercially available processes such as, for example, welding, or slotted or solid expandable connectors. In a preferred embodiment, the slotted casing 145 is coupled to the solid casing 135 by expandable solid connectors.

The slotted casing 145 is preferably coupled to one or more intermediate solid casings 150. The slotted casing 145 may be coupled to the intermediate solid casing 150 using any number of conventional commercially available processes such as, for example, welding or expandable solid or slotted connectors. In a preferred embodiment, the slotted casing 145 is coupled to the intermediate solid casing 150 by expandable solid connectors.

The last slotted casing 145 is preferably coupled to the shoe 155. The last slotted casing 145 may be coupled to the shoe 155 using any number of conventional commercially available processes such as, for example, welding or expandable solid or slotted connectors. In a preferred embodiment, the last slotted casing 145 is coupled to the shoe 155 by an expandable solid connector.

In an alternative embodiment, the shoe 155 is coupled directly to the last one of the intermediate solid casings 150.

In a preferred embodiment, the slotted casings 145 are positioned within the wellbore 105 by expanding the slotted casings 145 in a radial direction into intimate contact with the interior walls of the wellbore 105. The slotted casings 145 may be expanded in a radial direction using any number of conventional commercially available processes.

The intermediate solid casing 150 permits fluids and other materials to pass between adjacent slotted casings 145. The intermediate solid casing 150 may comprise any number of conventional commercially available sections of solid tubular casing such as, for example, oilfield tubulars fabricated from chromium steel or fiberglass. In a preferred embodiment, the intermediate solid casing 150 comprises oilfield tubulars available from foreign and domestic steel mills.

The intermediate solid casing 150 is preferably coupled to one or more sections of the slotted casing 145. The intermediate solid casing 150 may be coupled to the slotted casing 145 using any number of conventional commercially available processes such as, for example, welding, or solid or slotted expandable connectors. In a preferred embodiment, the intermediate solid casing 150 is coupled to the slotted casing 145 by expandable solid connectors. The intermediate solid casing 150 may comprise a plurality of such intermediate solid casing 150.

In a preferred embodiment, each intermediate solid casing 150 includes one more valve members 170 for controlling the flow of fluids and other materials within the interior region of the intermediate casing 150. In an alternative embodiment, as will be recognized by persons having ordinary skill in the art and the benefit of the present disclosure, during the production mode of operation, an internal tubular string with various arrangements of packers, perforated tubing, sliding sleeves, and valves may be employed within the apparatus to provide various options for commingling and isolating subterranean zones from each other while providing a fluid path to the surface.

In a particularly preferred embodiment, the intermediate casing 150 is placed into the wellbore 105 by expanding the intermediate casing 150 in the radial direction into intimate contact with the interior walls of the wellbore 105. The intermediate casing 150 may be expanded in the radial direction using any number of conventional commercially available methods.

In an alternative embodiment, one or more of the intermediate solid casings 150 may be omitted. In an alternative preferred embodiment, one or more of the slotted casings 145 are provided with one or more seals 140.

The shoe 155 provides a support member for the apparatus 130. In this manner, various production and exploration tools may be supported by the show 150. The shoe 150 may comprise any number of conventional commercially available shoes suitable for use in a wellbore such as, for example, cement filled shoe, or an aluminum or composite shoe. In a preferred embodiment, the shoe 150 comprises an aluminum shoe available from Halliburton. In a preferred embodiment, the shoe 155 is selected to provide sufficient strength in compression and tension to permit the use of high capacity production and exploration tools.

In a particularly preferred embodiment, the apparatus 130 includes a plurality of solid casings 135, a plurality of seals 140, a plurality of slotted casings 145, a plurality of intermediate solid casings 150, and a shoe 155. More generally, the apparatus 130 may comprise one or more solid casings 135, each with one or more valve members 160, n slotted casings 145, n−1 intermediate solid casings 150, each with one or more valve members 170, and a shoe 155.

During operation of the apparatus 130, oil and gas may be controllably produced from the targeted oil sand zone 125 using the slotted casings 145. The oil and gas may then be transported to a surface location using the solid casing 135. The use of intermediate solid casings 150 with valve members 170 permits isolated sections of the zone 125 to be selectively isolated for production. The seals 140 permit the zone 125 to be fluidicly isolated from the zone 120. The seals 140 further permits isolated sections of the zone 125 to be fluidicly isolated from each other. In this manner, the apparatus 130 permits unwanted and/or non-productive subterranean zones to be fluidicly isolated.

In an alternative embodiment, as will be recognized by persons having ordinary skill in the art and also having the benefit of the present disclosure, during the production mode of operation, an internal tubular string with various arrangements of packers, perforated tubing, sliding sleeves, and valves may be employed within the apparatus to provide various options for commingling and isolating subterranean zones from each other while providing a fluid path to the surface.

An apparatus has been described that includes one or more solid tubular members, one or more slotted tubular members, and a shoe. Each solid tubular member includes one or more external seals. The slotted tubular members are coupled to the solid tubular members. The shoe is coupled to one of the slotted tubular members. In a preferred embodiment, the apparatus further includes one or more intermediate solid tubular members coupled to and interleaved among the slotted tubular members. Each intermediate solid tubular member preferably includes one or more external seals. In a preferred embodiment, one or more of the solid tubular members include one or more valve members. In a preferred embodiment, one or more of the intermediate solid tubular members include one or more valve members.

An apparatus has been described that includes one or more primary solid tubulars, n slotted tubulars, n−1 intermediate solid tubulars, and a shoe. Each primary solid tubular includes one or more external annular seals. The slotted tubulars are coupled to the primary solid tubulars. The intermediate solid tubulars are coupled to and interleaved among the slotted tubulars. Each intermediate solid tubular includes one or more external annular seals. The shoe is coupled to one of the slotted tubulars.

A method of isolating a first subterranean zone from a second subterranean zone in a wellbore has been described that includes positioning one or more primary solid tubulars and one or more slotted tubulars within the wellbore. The primary solid tubulars traverse the first subterranean zone and the slotted tubulars traverse the second subterranean zone. The slotted tubulars and the solid tubulars are fluidicly coupled. The passage of fluids from the first subterranean zone to the second subterranean zone within the wellbore external to the solid and slotted tubulars is prevented.

A method of extracting materials from a producing subterranean zone in a wellbore, at least a portion of the wellbore including a casing, has been described that includes positioning one or more primary solid tubulars and one or more slotted tubulars within the wellbore. The primary solid tubulars are fluidicly coupled with the casing. The slotted tubulars traverse the producing subterranean zone. The producing subterranean zone is fluidicly isolated from at least one other subterranean zone within the wellbore. At least one of the slotted tubulars is fluidicly coupled with the producing subterranean zone. In a preferred embodiment, the method further includes controllably fluidicly decoupling at least one of the slotted tubulars from at least one other of the slotted tubulars.

Although illustrative embodiments of the invention have been shown and described, a wide range of modification, changes and substitution is contemplated in the foregoing disclosure. In some instances, some features of the present invention may be employed without a corresponding use of the other features. Accordingly, it is appropriate that the appended claims be construed broadly and in a manner consistent with the scope of the invention.

What is claimed is:

1. An apparatus, comprising:

one or more solid tubular members, each solid tubular member including one or more external seals;

one or more slotted tubular members coupled to the solid tubular members; and a shoe coupled to one of the slotted tubular members.

2. The apparatus of claim 1, further comprising;

one or more intermediate solid tubular members coupled to and interleaved among the slotted tubular members, each intermediate solid tubular member including one or more external seals.

3. The apparatus of claim 2, wherein one or more of the intermediate solid tubular members include one or more valve members.

4. The apparatus of claim 1, further comprising one or more valve members for controlling the flow of fluidic materials between the tubular members.

5. The apparatus of claim 1, further comprising: a plurality of slotted tubular members coupled to the solid tubular member, each slotted tubular member consisting of:

a tubular member defining a longitudinal passage and one or more radial passages fluidicly coupled to the longitudinal passage.

6. An apparatus, comprising:

one or more primary solid tubulars, each primary solid tubular including one or more external annular seals;

n slotted tubulars coupled to the primary solid tubulars;

n−1 intermediate solid tubulars coupled to and interleaved among the slotted tubulars, each intermediate solid tubular including one or more external annular seals; and a shoe coupled to one of the slotted tubulars.

7. The apparatus of claim 6, wherein n is greater than or equal to 2.

8. The apparatus of claims 6, wherein n is greater than or equal to 2; and wherein each slotted tubular member consists of:

a tubular member defining a longitudinal passage and one or more radial passages fluidicly coupled to the longitudinal passage.

9. A method of isolating a first subterranean zone from a second subterranean zone in a wellbore, comprising:

positioning one or more primary solid tubulars within the wellbore, the primary solid tubulars traversing the first subterranean zone;

positioning one or more slotted tubulars within the wellbore, the slotted tubulars traversing the second subterranean zone;

fluidicly coupling the slotted tubulars and the solid tubulars; and preventing the passage of fluids from the first subterranean zone to the second subterranean zone within the wellbore external to the solid and slotted tubulars.

10. The method of claim 9, further comprising:

positioning a plurality of slotted tubulars within the wellbore, each slotted tubular consisting of:

a tubular member defining a longitudinal passage and one or more radial passages fluidicly coupled to the longitudinal passage.

11. A method of extracting materials from a producing subterranean zone in a wellbore, at least a portion of the wellbore including a casing, comprising;

positioning one or more primary solid tubulars within the wellbore;

fluidicly coupling the primary solid tubulars with the casing;

positioning one or more slotted tubulars within the wellbore, the slotted tubulars traversing the producing subterranean zone;

fluidicly coupling the slotted tubulars with the solid tubulars;

fluidicly isolating the producing subterranean zone from at least one other subterranean zone within the wellbore; and fluidicly coupling at least one of the slotted tubulars with the producing subterranean zone.

12. The method of claim 11, further comprising:

controllably fluidicly decoupling at least one of the slotted tubulars from at least one other of the slotted tubulars.

13. The method of claim 11, further comprising:

positioning a plurality of slotted tubulars within the wellbore, each slotted tubular consisting of:

a tubular member defining a longitudinal passage and one or more radial passages fluidicly coupled to the longitudinal passage.

14. An apparatus, comprising:

a subterranean formation including a wellbore;

one or more solid tubular members positioned within the wellbore, each solid tubular member including one or more external seals;

one or more slotted tubular members positioned within the wellbore coupled to the solid tubular members; and a shoe positioned within the wellbore coupled to one of the slotted tubular members;

wherein at least one of the solid tubular members and the slotted tubular members are formed by a radial expansion process performed within the wellbore.

15. The apparatus of claim 14, further comprising;

one or more intermediate solid tubular members positioned within the wellbore coupled to and interleaved among the slotted tubular members, each intermediate solid tubular member including one or more external seals;

wherein at least one of the solid tubular members, the slotted tubular members, and the intermediate solid tubular members are formed by a radial expansion process performed within the wellbore.

16. The apparatus of claim 15, wherein one or more of the intermediate solid tubular members include one or more valve members for controlling the flow of fluids between the solid tubular members and the slotted tubular members.

17. The apparatus of claim 14, further comprising one or more valve members for controlling the flow of fluids between the solid tubular members and the slotted tubular members.

18. An apparatus, comprising:

a subterranean formation including a wellbore;

one or more primary solid tubulars positioned within the wellbore, each primary solid tubular including one or more external annular seals;

n slotted tubulars positioned within the wellbore coupled to the primary solid tubulars;

n−1 intermediate solid tubulars positioned within the wellbore coupled to and interleaved among the slotted tubulars, each intermediate solid tubular including one or more external annular seals; and a shoe coupled to one of the slotted tubulars;

wherein at least one of the primary solid tubulars, the slotted tubulars, and the intermediate solid tubulars are formed by a radial expansion process performed within the wellbore.

19. The apparatus of claim 18, wherein n is greater than or equal to 2.

20. A method of isolating a first subterranean zone from a second subterranean zone in a wellbore, comprising:

positioning one or more primary solid tubulars within the wellbore, the primary solid tubulars traversing the first subterranean zone;

positioning one or more slotted tubulars within the wellbore, the slotted tubulars traversing the second subterranean zone;

radially expanding at least one of the primary and slotted tubulars within the wellbore;

fluidicly coupling the slotted tubulars and the solid tubulars; and preventing the passage of fluids from the first subterranean zone to the second subterranean zone within the wellbore external to the solid and slotted tubulars.

21. A method of extracting materials from a producing subterranean zone in a wellbore, at least a portion of the wellbore including a casing, comprising;

positioning one or more primary solid tubulars within the wellbore;

positioning one or more slotted tubulars within the wellbore, the slotted tubulars traversing the producing subterranean zone;

radially expanding at least one of the primary solid tubulars and the slotted tubulars within the wellbore;

fluidicly coupling the primary solid tubulars with the casing;

fluidicly coupling the slotted tubulars with the solid tubulars;

fluidicly isolating the producing subterranean zone from at least one other subterranean zone within the wellbore; and fluidicly coupling at least one of the slotted tubulars with the producing subterranean zone.

22. The method of claim 21, further comprising:

controllably fluidicly decoupling at least one of the slotted tubulars from at least one other of the slotted tubulars.

23. An apparatus, comprising:

a subterranean formation including a wellbore;

n solid tubular members positioned within the wellbore, each solid tubular member including one or more external seals;

n−1 slotted tubular members positioned within the wellbore coupled to and interleaved among the solid tubular members; and a shoe positioned within the wellbore coupled to one of the slotted tubular members.

24. The apparatus of claim 23, further comprising one or more valve members for controlling the flow of fluids between the solid tubular members and the slotted tubular members.

25. The apparatus of claim 23, wherein one or more of the solid tubular members include one or more valve members for controlling the flow of fluids between the solid tubular members and the slotted tubular members.

26. The apparatus of claim 23, wherein n is greater than or equal to 3.

27. The apparatus of claim 23, wherein n is greater than or equal to 3; and wherein each slotted tubular member consists of:

a tubular member defining a longitudinal passage and one or more radial passages fluidicly coupled to the longitudinal passage.

28. A system for isolating a first subterranean zone from a second subterranean zone in a wellbore, comprising:

means for positioning one or more primary solid tubulars within the wellbore, the primary solid tubulars traversing the first subterranean zone;

means for positioning one or more slotted tubulars within the wellbore, the slotted tubulars traversing the second subterranean zone;

means for fluidicly coupling the slotted tubulars and the solid tubulars; and means for preventing the passage of fluids from the first subterranean zone to the second subterranean zone within the wellbore external to the solid and slotted tubulars.

29. The system of claim 28, further comprising means for positioning a plurality of slotted tubulars within the wellbore; wherein each slotted tubular consists of:

a tubular member defining a longitudinal passage and one or more radial passages fluidicly coupled to the longitudinal passage.

30. A system for extracting materials from a producing subterranean zone in a wellbore, at least a portion of the wellbore including a casing, comprising;

means for positioning one or more primary solid tubulars within the wellbore;

means for fluidicly coupling the primary solid tubulars with the casing;

means for positioning one or more slotted tubulars within the wellbore, the slotted tubulars traversing the producing subterranean zone;

means for fluidicly coupling the slotted tubulars with the solid tubulars;

means for fluidicly isolating the producing subterranean zone from at least one other subterranean zone within the wellbore; and means for fluidicly coupling at least one of the slotted tubulars with the producing subterranean zone.

31. The system of claim 30, further comprising: means for controllably fluidicly decoupling at least one of the slotted tubulars from at least one other of the slotted tubulars.

32. The system of claim 30, further comprising means for positioning a plurality of slotted tubulars within the wellbore; wherein each slotted tubular consists of:

a tubular member defining a longitudinal passage and one or more radial passages fluidicly coupled to the longitudinal passage.

33. A system for isolating a first subterranean zone from a second subterranean zone in a wellbore, comprising:

means for positioning one or more primary solid tubulars within the wellbore, the primary solid tubulars traversing the first subterranean zone;

means for positioning one or more slotted tubulars within the wellbore, the slotted tubulars traversing the second subterranean zone;

means for radially expanding at least one of the primary and slotted tubulars within the wellbore;

means for fluidicly coupling the slotted tubulars and the solid tubulars; and means for preventing the passage of fluids from the first subterranean zone to the second subterranean zone within the wellbore external to the solid and slotted tubulars.

34. A system for extracting materials from a producing subterranean zone in a wellbore, at least a portion of the wellbore including a casing, comprising;

means for positioning one or more primary solid tubulars within the wellbore;

means for positioning one or more slotted tubulars within the wellbore, the slotted tubulars traversing the producing subterranean zone;

means for radially expanding at least one of the primary solid tubulars and the slotted tubulars within the wellbore;

means for fluidicly coupling the primary solid tubulars with the casing;

means for fluidicly coupling the slotted tubulars with the solid tubulars;

means for fluidicly isolating the producing subterranean zone from at least one other subterranean zone within the wellbore; and means for fluidicly coupling at least one of the slotted tubulars with the producing subterranean zone.

35. The system of claim 34, further comprising:

means for controllably fluidicly decoupling at least one of the slotted tubulars from at least one other of the slotted tubulars.

* * * * *

UNITED STATES PATENT AND TRADEMARK OFFICE

CERTIFICATE OF CORRECTION

PATENT NO. : 6,328,113 B1
DATED : December 11, 2001
INVENTOR(S) : Robert Lance Cook It is certified that error appears in the above-identified patent and that said Letters Patent is hereby corrected as shown below:

Title page,
Please add the following under U.S. PATENT DOCUMENTS,

-- 4,069,573 01/1978 Rogers, Jr., et al. …….. 29/421 R --

Column 2,
Line 10, please replace "ILLUSTRATION" with -- ILLUSTRATIVE --

Column 4,
Line 42, please replace "show 150" with -- shoe 155 --
Line 42, please replace "shoe 150" with -- shoe 155 --
Line 46, please replace "shoe 150" with -- shoe 155 --

Column 6,
Line 67, please replace ";" with -- : --

Signed and Sealed this

Second Day of July, 2002

*Attest:*

*Attesting Officer*

JAMES E. ROGAN
*Director of the United States Patent and Trademark Office*